US009751202B2

(12) United States Patent
Frazer

(10) Patent No.: US 9,751,202 B2
(45) **Date of Patent: *Sep. 5, 2017**

(54) ASSISTED OPENING MULTITOOL METHOD AND APPARATUS

(71) Applicant: Spencer Frazer, Lynnwood, WA (US)

(72) Inventor: Spencer Frazer, Lynnwood, WA (US)

( * ) Notice: Subject to any disclaimer, the term of this patent is extended or adjusted under 35 U.S.C. 154(b) by 562 days.

This patent is subject to a terminal disclaimer.

(21) Appl. No.: 13/971,812

(22) Filed: Aug. 20, 2013

(65) Prior Publication Data

US 2014/0196218 A1 Jul. 17, 2014

Related U.S. Application Data

(63) Continuation of application No. 12/696,467, filed on Jan. 29, 2010, now Pat. No. 8,511,208.

(60) Provisional application No. 61/148,274, filed on Jan. 29, 2009.

(51) Int. Cl.

| | |
|---|---|
| ***B25F 1/04*** | (2006.01) |
| ***B25F 1/00*** | (2006.01) |
| *B25B 7/02* | (2006.01) |
| *B25B 7/00* | (2006.01) |

(52) U.S. Cl.

CPC ..... *B25F 1/04* (2013.01); *B25F 1/003* (2013.01); *B25B 7/00* (2013.01); *B25B 7/02* (2013.01)

(58) Field of Classification Search

CPC ... B25F 1/04; B25F 1/003; B25B 7/00; B25B 7/02; B25G 1/102; B25G 1/12

USPC ..... 81/427.5; 30/260, 452, 453, 455, 458, 30/459, 336, 337

See application file for complete search history.

(56) References Cited

U.S. PATENT DOCUMENTS

| | | | | |
|---|---|---|---|---|
| 4,238,862 | A * | 12/1980 | Leatherman | B25B 7/22 7/128 |
| 5,664,274 | A * | 9/1997 | Collins | B25F 1/003 224/904 |
| 5,979,059 | A * | 11/1999 | Leatherman | B25F 1/04 30/161 |
| 6,006,385 | A * | 12/1999 | Kershaw | B25F 1/04 7/128 |
| 7,107,686 | B2 * | 9/2006 | Linn | B26B 1/044 30/159 |
| 7,140,110 | B2 * | 11/2006 | Lake | B26B 1/042 30/160 |
| 7,337,486 | B2 * | 3/2008 | Tsuda | B24D 15/084 7/120 |
| 8,099,870 | B1 * | 1/2012 | Ralph | B26B 1/046 30/158 |
| 8,511,208 | B1 * | 8/2013 | Frazer | B25F 1/04 30/159 |
| 2007/0022849 | A1 * | 2/2007 | Poehlmann | B25F 1/04 81/427.5 |

* cited by examiner

*Primary Examiner* — Larry E Waggle, Jr.
*Assistant Examiner* — Danny Hong
(74) *Attorney, Agent, or Firm* — Forest Law Office, P.C.

(57) ABSTRACT

An assisted opening multitool handle comprising a handle housing having a longitudinal axis and a lateral axis, the handle housing having first and second longitudinal regions, the handle housing having an interior surface defining a channel region. The assisted opening multitool handle further comprises a tool member pivotally attached to the handle housing and operatively configured to be positioned in a closed orientation within the channel region and configured to rotate in an opening direction to an open orientation.

1 Claim, 15 Drawing Sheets

20
56
190
44
54
UNLOCK
52
26
30'
2
2
12
10
14
30
38
22

3
11
48
12
16
10
17
40
34
36
42
30
38
26
32
120
122
124
110
50
28
3
11

ASSISTED OPENING MULTITOOL METHOD AND APPARATUS

RELATED APPLICATIONS

This application is a continuation of prior application Ser. No. 12/696,467, filed Jan. 29, 2010, which in turn claims the benefit of U.S. Provisional Application No. 61/148,274, filed Jan. 29, 2009.

BACKGROUND

Multitools are available in a variety of orientations and forms to provide a plier-like member, such as a needle-nose pliers, and a plurality of tool members which are generally housed within a channel region of one or both of the handle members.

Oftentimes, it is desirable to operate a handle member by way of utilizing the tool with one hand while the other hand is occupied. As described herein, providing an assisted opening system allows a user to easily extract a tool member from a multitool handle, where such assisted opening system biases the tool to an open orientation. In one form, two tool members can be utilized to be opened using an assisted opening system. In a preferred form, the tool member requires an external torque applied thereto to reposition a first portion of rotation, and thereafter, the net forces acting upon the multitool bias the multitool placing a net positive torque thereon to open the tool to an extended orientation.

SUMMARY OF THE DISCLOSURE

An assisted opening multitool handle comprising a handle housing having a longitudinal axis and a lateral axis, the handle housing having first and second longitudinal regions, the handle housing having an interior surface defining a channel region. The assisted opening multitool handle further comprises a tool member pivotally attached to the handle housing and operatively configured to be positioned in a closed orientation within the channel region and configured to rotate in an opening direction to an open orientation.

In some embodiments, the assisted opening multitool handle comprises an assisted opening system comprising a spring system operatively attached to the tool member where the spring system provides rotational resistance of the tool for a first portion of rotation of the tool member from the closed orientation to the open orientation, and the spring system provides positive torque for a second portion of rotation between the closed orientation and the open orientation where the second portion of rotation is after the first portion of rotation from the closed orientation to the open orientation of the tool member with respect to the handle housing.

In another form of the assisted opening multitool handle, the tool member can be a first tool member and the second tool member may be positioned at an opposing lateral portion of the handle housing with respect to the first tool member.

DESCRIPTION OF THE PREFERRED EMBODIMENTS

Figure 1:
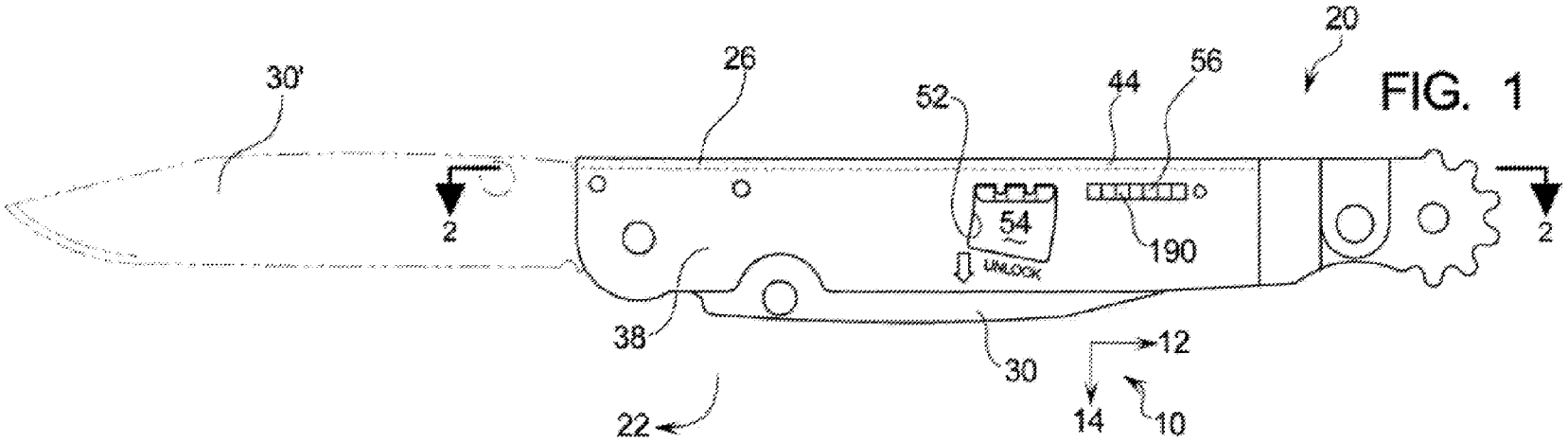
FIG. 1 shows a side view of an assisted opening multitool handle which is a portion of a multitool.
Figure 2:
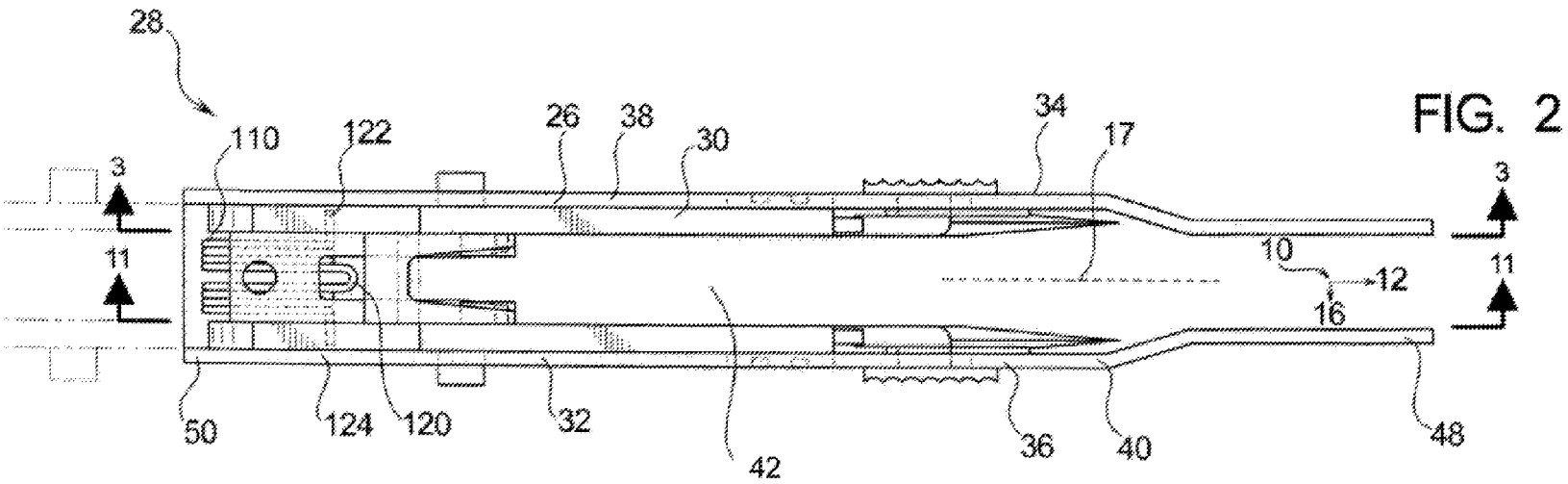
FIG. 2 is taken at line 2-2 of FIG. 1 showing the assisted opening system and the first and second tool members housed within the chamber region of the housing handle.
Figure 4:
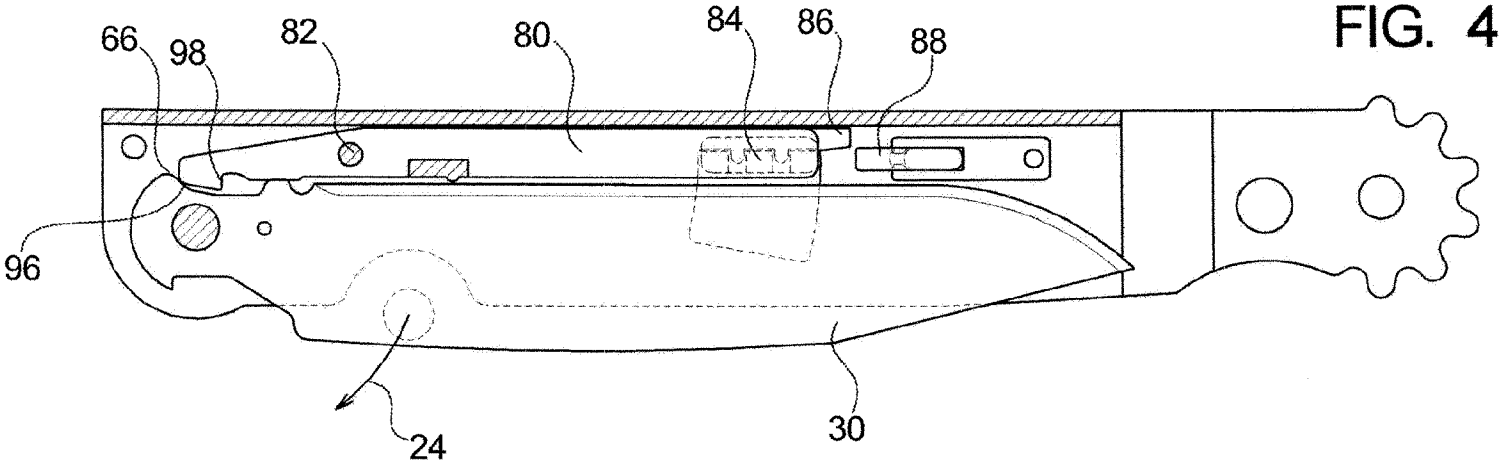
FIG. 4 shows the lock notch disengaging from the lock extension.
Figure 34:
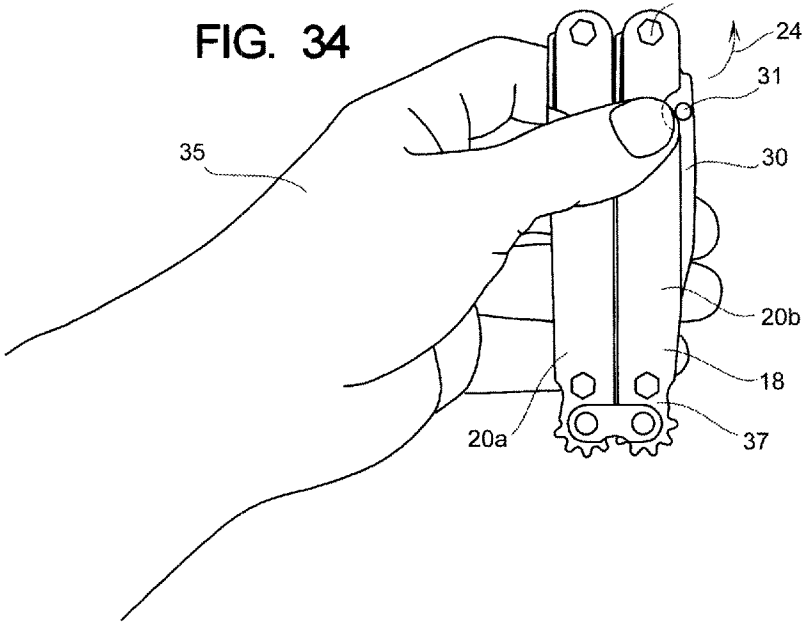
FIG. 34 shows an assisted opening multitool device with a tool in the closed position.

As shown in FIG. 1, there is an assisted opening multitool handle 20. In general, the handle 20 is a part of a multitool 18 as shown in FIG. 34. To aid in the description of the drawing, an axes system 10 is defined where the axis 12 indicates the longitudinal direction and the axis 14 indicates the transverse direction. Further, as shown in FIG. 2, the substantially orthogonal axis 16 indicates a lateral direction. The longitudinal center reference line 17 extends substantially along the longitudinal axis, and outward from this reference line is a laterally outward direction. The rotational vector 22 as shown in FIG. 1 indicates a direction referred to as an opening direction. Further, as shown in FIG. 4, the rotational arrow 24 is referred to as an opening torque referring to an external force applied to the tool member 30 to initially assist the opening thereof. The directions/motions opposing the opening direction 22 are referred to as the closing direction, and a force applied to a tool member 30 in the opposing direction of the vector 24 is referred to as a closing torque.

Now referring back to FIG. 1, there will be a general discussion of the components of the assisted opening multitool handle 20. The handle 20 comprises a handle housing 26, an assisted opening system 28, and at least one tool member 30. In one form, there is a second tool member 32.

As shown in FIG. 2, the handle housing 26 comprises first and second lateral regions 34 and 36, where at the first lateral region 34 there is a first lateral wall 38. At the opposing lateral region (the second lower region 36), there is a second lateral wall 40. The first and second lateral walls have interior surfaces to define a channel region 42. In general, the channel region is a substantially U-shaped channel between the first and second lateral walls 38 and 40 and the base wall 44.

The handle housing 26 further comprises a first longitudinal region 48 and a second longitudinal region 50. In one form, a surface 52 defines the opening 54 to allow the release lever 80 to extend therethrough. Further, the lock member can be positioned in the surface defining the opening 56 so the user can lock the tool member in a closed orientation as further described herein.

Figure 3:
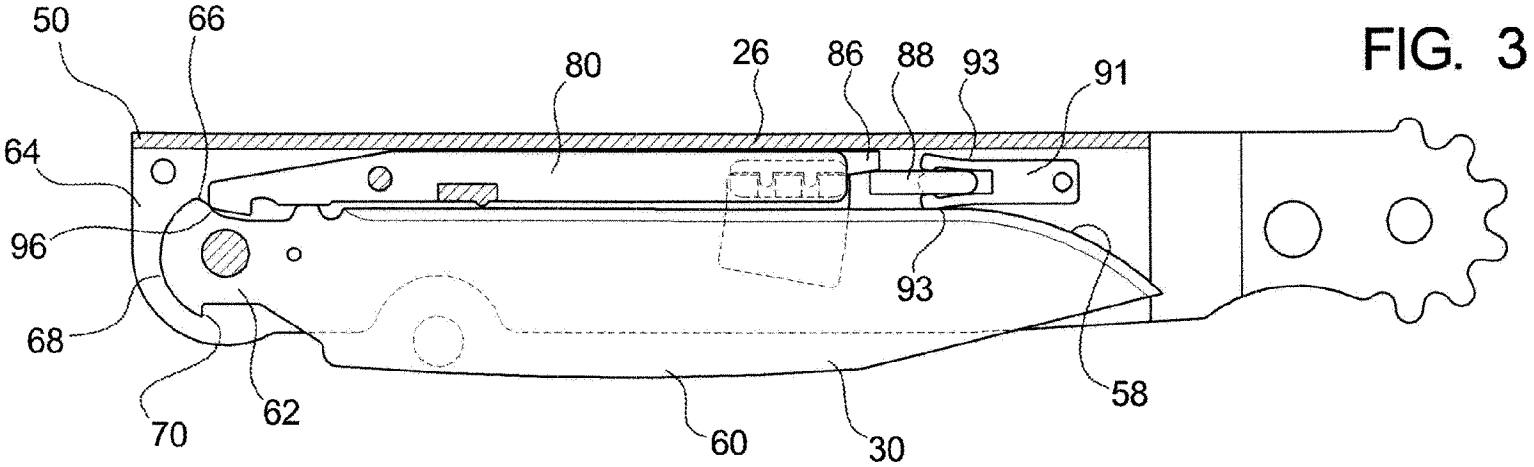
FIG. 3 shows a cross sectional view taken at line 3-3 of FIG. 2 showing the release lever and the tool member which in one form is a blade in the non-extended orientation.

Referring now to FIG. 3, the tool member 30, which in one form is a blade, has an edge portion 58 and a back region 60. The blade further has a pivot connection region 62 where the blade is pivotally connected to the second longitudinal region 50 of the handle member 26. In one form, the blade has a tool cam surface 64 located near the pivot connection region 62. The tool cam surface comprises several regions which will now be described in detail. In general, the various regions, in one form, work in conjunction with the assisted opening system 28 to provide a closing torque directional resistance to the spring member 110 described further herein and further described in U.S. Pat. No. 6,941,661, which is incorporated by reference.

The tool cam surface 64 comprises, in one form, the resistance cam surface 66 which is adapted to engage the cam engagement portion 96 of the release lever 80 described further herein. Adjacent to the resistance cam surface 66 is the cam opening portion 68 followed by the tool lock surface 70.

Referring now to FIG. 4, there is shown the release lever 80 which is pivotally attached at the pivot location 82. The release lever comprises an interface portion 84, and in general, the release lever is one form of a release system for repositioning the blade from an extended orientation to a closed orientation as described herein with reference to FIGS. 6 and 7. Referring back now to FIG. 3, the release lever 80 comprises, in one form, a lock notch 86 which is operatively configured to engage the lock extension 88. As shown in FIG. 1, the lock member is shown with an external surface 190 where the user can selectively have the lock extension 88 engage the lock notch, preventing rotation of the release lever 80 as shown in FIG. 3. Alternatively, the interface portion 84 can be retracted to an orientation as shown in FIG. 4 where the lock extension 88 is not in engagement with the lock notch 86 to allow rotation of the release lever 80. Still referring to FIG. 4, it can be appreciated that the release lever in the current embodiment comprises a cam engagement portion 96 as well as a lever lock surface 98. Because the resistance cam surface portion 66 is at a positive angle with respect to rotation of the tool member 30 in the opening direction, there is a resistance or closing torque applied to the tool 30, which with reference to FIG. 4, acts in the counterclockwise direction. However, when an opening torque 24 is applied to the tool 30 as shown in FIG. 4, the blade can reposition to an orientation such as that shown in FIG. 5.

Figure 5:
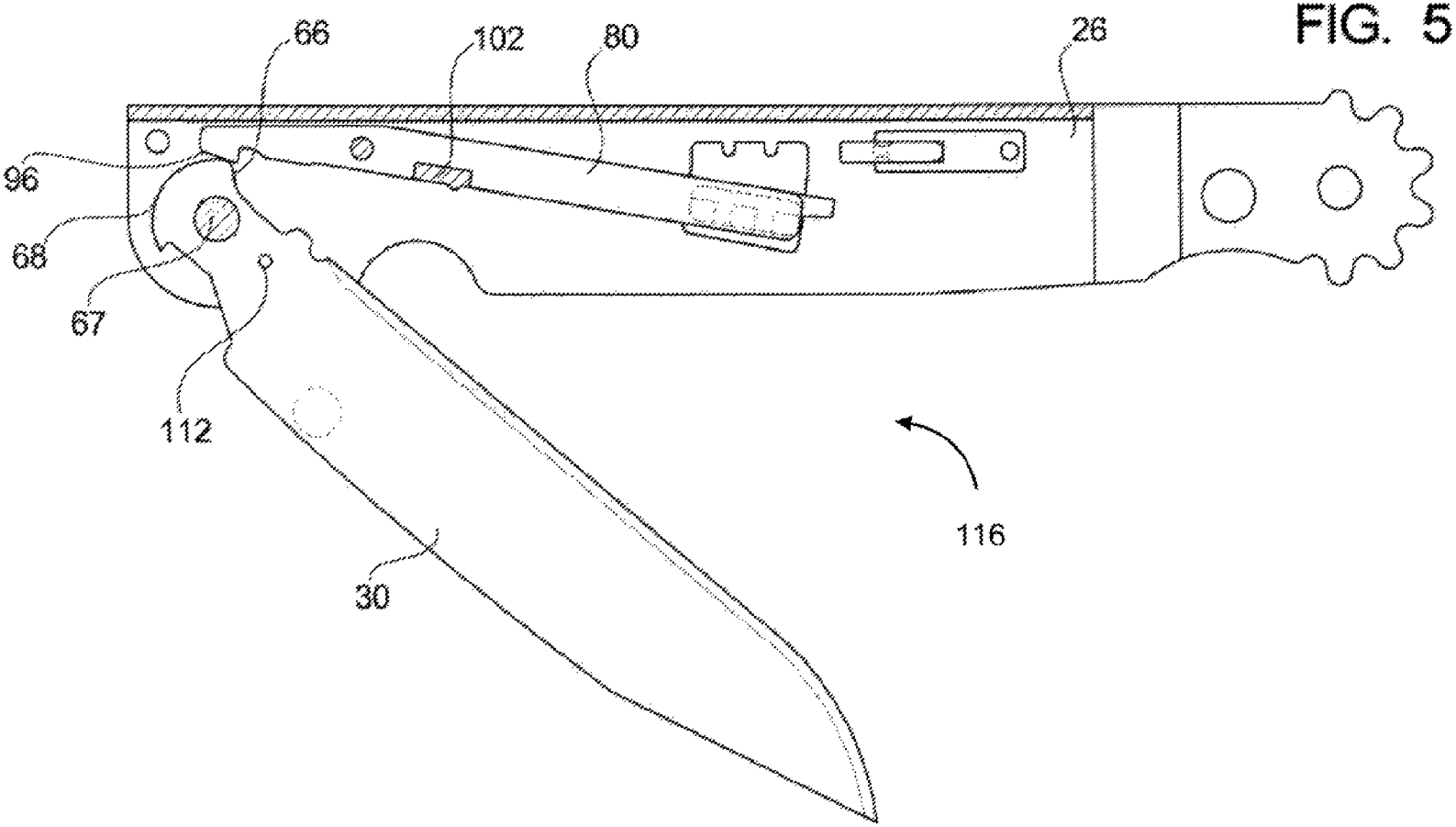
FIG. 5 shows the tool member in a partially open orientation where the cam engagement portion of the release lever has passed the portion of the cam surface, referred to as the resistance cam surface, which provides rotational resistance of the tool member.
Figure 11:
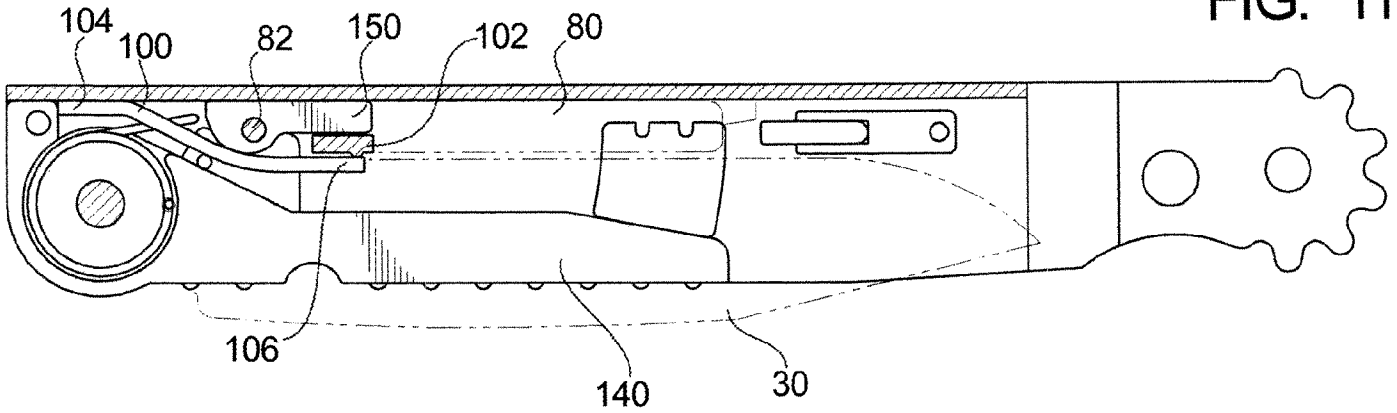
FIG. 11 is taken at line 11-11 of FIG. 2 showing the assisted opening housing and the release lever spring.

FIG. 5 shows a transition point of rotation where the release lever 80 is in a stored energy orientation. Referring ahead to the embodiment in FIG. 11, it can be appreciated that the release lever spring 100 places a torque about the release lever so it rotates in the counterclockwise direction. In one form, the release lever spring is fixedly attached at the region 104 and engages the release lever 80 at the portion 106. Therefore, the extension 102 as shown in FIG. 11 provides for an engagement surface so force can be imparted upon the release lever 80. Referring back to the embodiment in FIG. 5, it can be appreciated that the extension 102 is positioned in a more clockwise orientation, which would slightly extend the release lever spring 100 (shown in FIG. 11).

Therefore, after the resistance cam surface 66 has repositioned the release lever to the stored energy orientation as shown in FIG. 5, the cam engagement portion 96 of the release lever will now slide along the cam opening portion 68 of the tool 30. In one form, the cam opening portion 68 has a substantially constant diameter about the rotation point 67. Referring back now to FIG. 2, it can be seen that the assisted opening system 28 in part comprises the spring member 110. In one form, the spring member 110 engages in one portion the tool 30 at the spring engagement portion 112 as shown in FIG. 5. In general, the spring member 110 supplies an opening torque to the tool 30 to assist the opening of the tool. Therefore, it can now be appreciated that this opening torque is counteracted by the closing torque, which occurs when the cam engagement portion 96 engages the resistance cam surface 66. As shown in FIG. 5, the approximate initial region of opening the tool member 30 with respect to the handle housing 26 is referred to as the first portion of rotation 116. During this first portion of rotation, an external opening torque indicated by arrow 24 in FIG. 4 must be applied to the blade members 30 to assist in the initial opening of the blade. After the transition point and through a second portion of rotation, which in this form is where the force of the spring member 110 (see FIG. 2) overtakes the counteracting force between the cam surface 66 and the cam engagement portion 96 of the release lever, the blade opens in an assisted manner to the fully extended orientation such as that shown in the hatched line 30' in FIG. 1.

Figure 12:
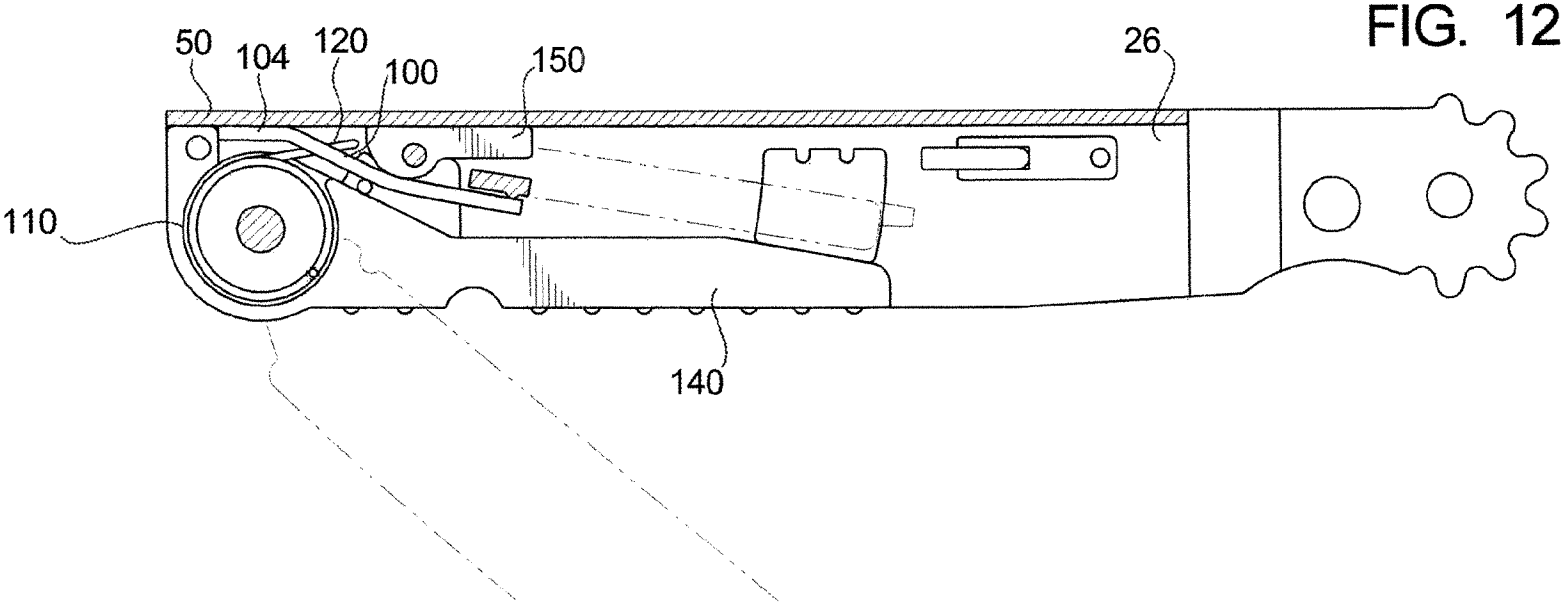
FIG. 12 shows the release lever spring in a higher potential energy state where the release lever is flexed outwardly.

Referring now to FIG. 12, it can be seen how the release lever spring 100 is in a stored energy state where the fixed portion 104 remains intact to the longitudinal region 50. As further shown in this figure, the spring member 110 has an extension portion 120 which in one form engages the handle housing 26. As shown in FIG. 2, this extension 120 in one form can be positioned between two adjacent tool engaging portions 122 and 124 which fit the spring engagement portion 112 of the tool 30 as shown in FIG. 5. It should be noted that in other forms, as shown in FIG. 5, the cam opening portion 68 of the tool 30 need not have the same radius with respect to the center of rotation 67. In fact, in other forms, the radius can gradually decrease with respect to the opening of the tool 30 to provide further assistance in the opening action whereby the stored energy within the release lever spring 100 (see FIG. 11) can be transferred through the release lever 80 to the cam engagement portion 96 to further assist the opening of the tool 30.

Figure 6:
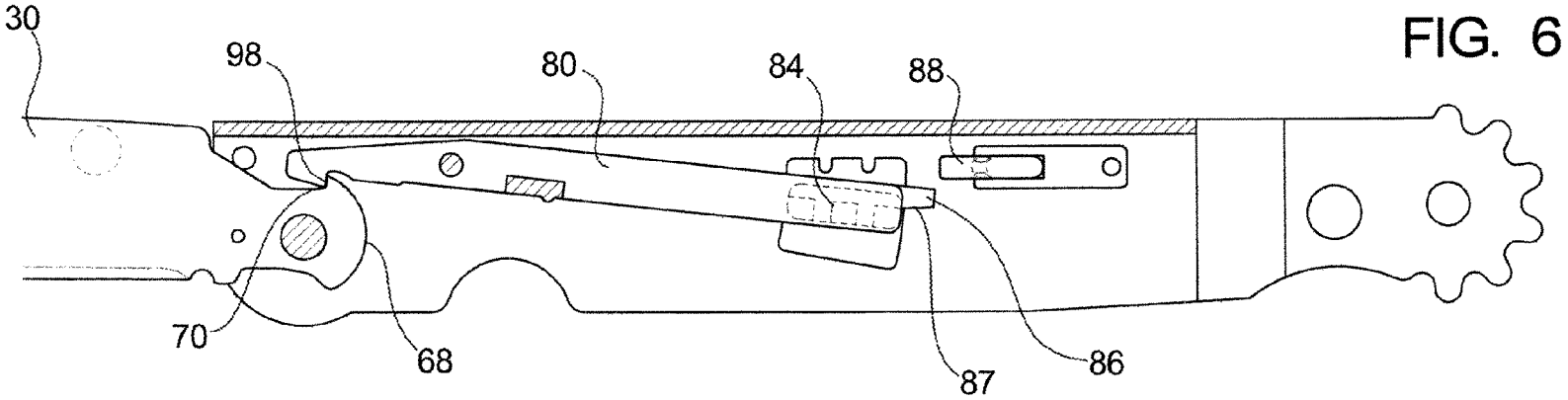
FIG. 6 shows the tool member in an extended orientation where the lever lock surface of the release lever engages the tool lock surface of the tool.

Now referring to FIG. 6, it can be appreciated that the tool member 30 is in a locked orientation where the tool lock surface 70 is now engaging the lever lock surface 98 of the release member 80. As soon as the cam engagement portion 96, in particular the ridge region thereof, passes the edge portion of the tool lock surface 70 from the cam opening portion 68, the stored energy in the spring 100 (as shown in FIG. 11) rotates the release lever 80 in the counterclockwise direction (with reference to FIG. 6) to maintain the tool member 30 in a locked orientation. It should be noted that the interface portion 84 is positioned through the opening 54 as shown in FIG. 1 to unlock the tool member 30. In one form, the orientation of the various cam surfaces of the tool member 30 can be such that the locking notch 86 can be positioned sufficiently in a counterclockwise orientation so the lock end 88 can engage the surface 87.

Figure 13:
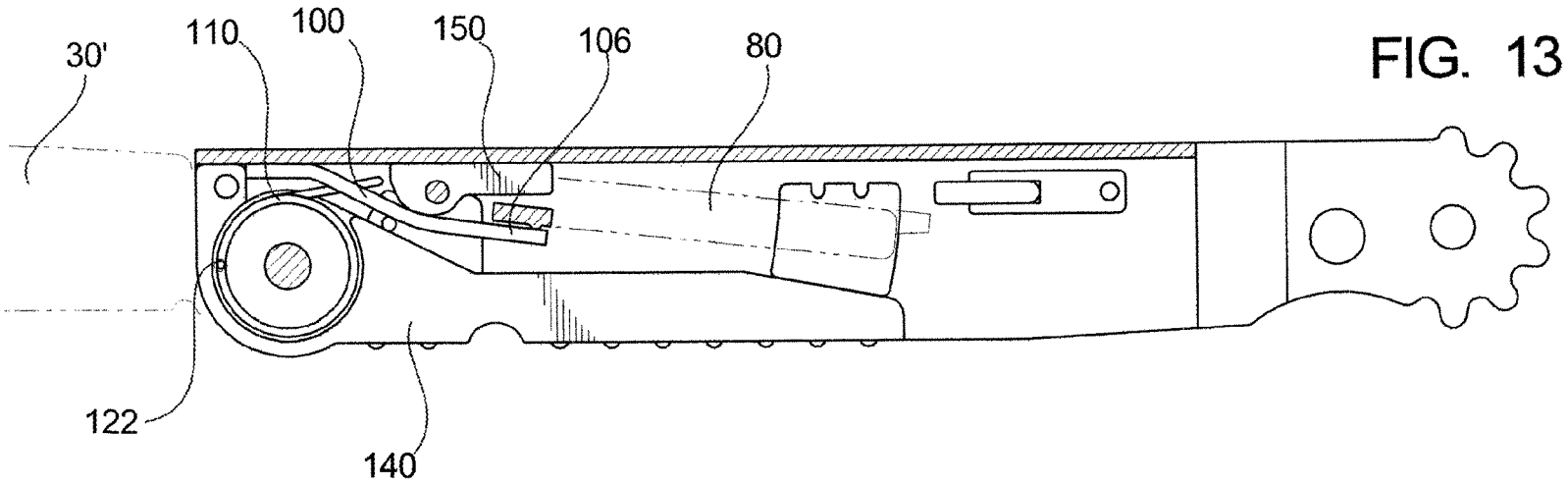
FIG. 13 shows the tool member in an open orientation and illustrates the positioning of the release lever spring.

FIG. 13 shows the assisted opening multitool handle take along line 11-11 where it can be appreciated that the release lever spring 100 rotates a small amount in the counterclockwise direction at the end 106 to rotates the lock lever 80 to the orientation as shown in FIG. 6. It should be further noted in FIG. 13 that the tool engagement portion 122 is now rotated in the opening direction (clockwise in FIG. 13) with respect to its orientation such as that shown in FIG. 12. Therefore, in one form, the torsional type of spring 110 has released some of its stored energy and stored tension to open the tool 30' shown in FIG. 13.

Figure 7:
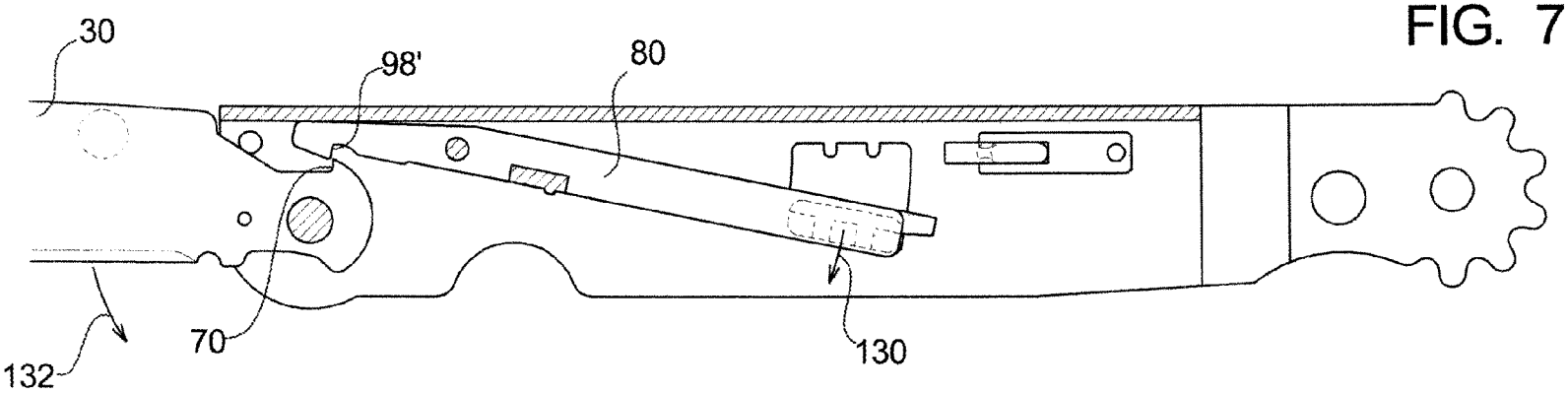
FIG. 7 shows the tool lock surface of the tool disengaged from the lever lock surface of the release lever.

Now referring to FIG. 7, it can be appreciated that an external torque 130 has imparted a force upon the release lever 80 whereby the lever lock surface 98 is not disengaged from the tool lock surface 70 of the tool member 30. Because the spring member 110 is still imparting a opening torque upon the tool member 30 (see FIG. 13), a tool closing external torque/force 132 as shown in FIG. 7 must be applied to the tool member 30 to close the tool from the extended orientation to the retracted orientation similar to that shown in FIG. 11.

Referring now back to FIG. 2, it can be appreciated that the second tool member 32 operates a similar manner as the first tool member. It should be further noted that FIG. 2 does not include the assisted opening housing 140 such as that shown in FIGS. 11-13.

Figure 8A:
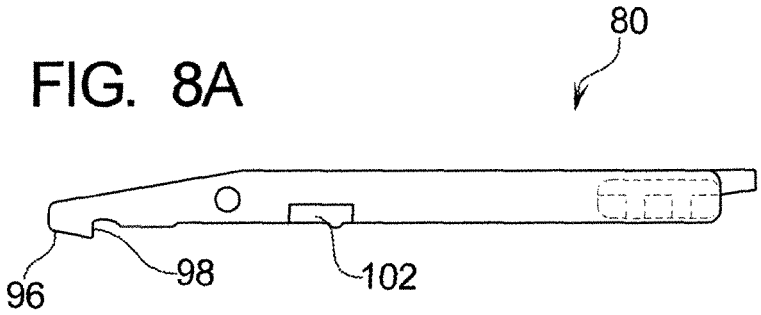
FIGS. 8A-8C show various views of the release lever.
Figure 8B:
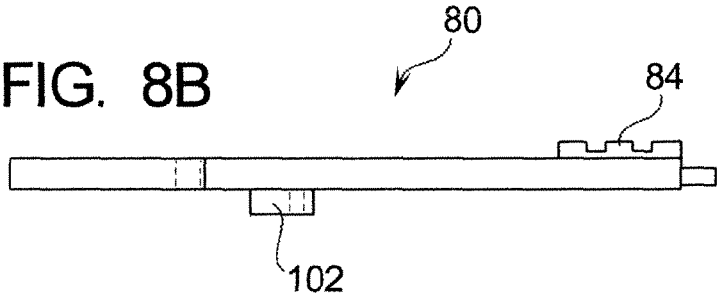
Figure 8C:
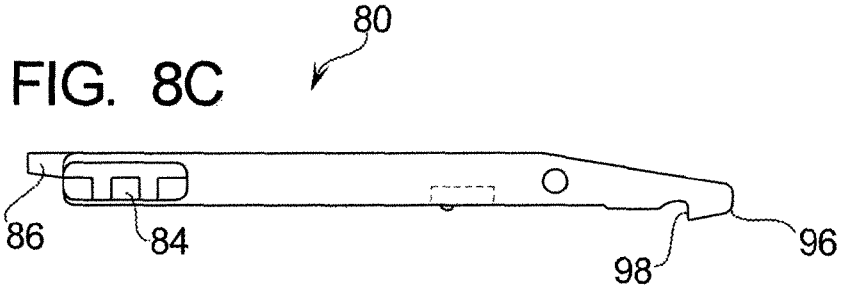
Figure 9:
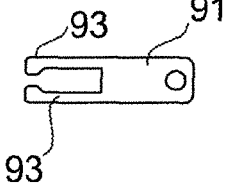
FIGS. 9-10 show of the biasing member and the lock extension, which in one form are used to lock the release lever in a first orientation.
Figure 10:
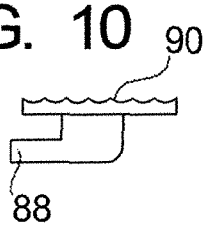

Referring to FIGS. 8A-8C, there is shown a detailed view of several orthogonal views of the release lever 80. As shown in FIGS. 9-10, there is a detailed view of one form of the lock system showing the lock extension 88 having the interface region 90 as shown in FIG. 1. FIG. 9 shows the biasing mechanism 91 which in one form is two cantilevered arms 93 adapted to separate in a stored energy state, such that shown in FIG. 3 when the lock extension 88 is engaging the lock notch 86.

Figure 14A:
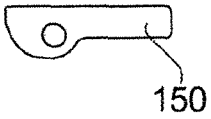
FIGS. 14A-14B show orientations of the spacing element.
Figure 14B:
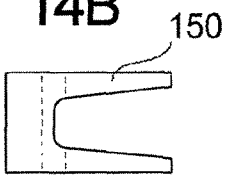

FIG. 14A shows a spacing element 150 which is shown in the assembly in FIGS. 11-13. In one form, the spacing element provides for a base support for the extension 102 of the release lever 80 to press against when the tool 30 is in a retracted orientation. FIG. 14B shows a front view of the spacing element 150.

Figure 15A:
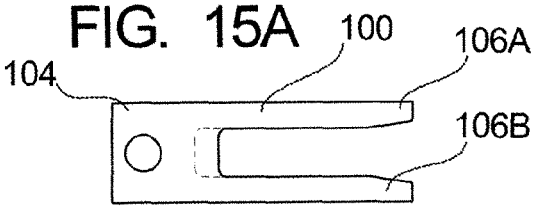
FIGS. 15A-15B show orientations of the release lever spring.
Figure 15B:
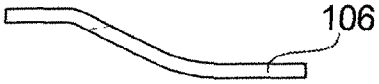

FIGS. 15A-15B show one form of the release lever spring 100 where the region 104 is mounted to the handle housing 26 as shown in FIGS. 11-13. FIG. 15 shows a side view where each of the end regions 106A and 106B as shown in FIG. 15A are cantilevered out to engage the extension 102 of the release lever 80 (see FIGS. 11-13).

Figure 16A:
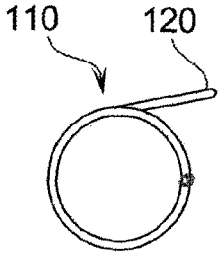
FIG. 16A-16B show two orientations of the spring member comprising, in part, the assisted opening system.
Figure 16B:
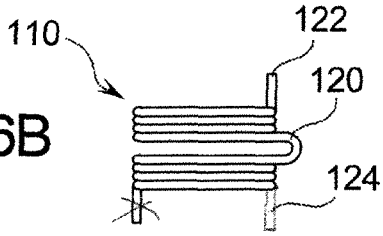

FIGS. 16A and 16B show one form of the spring member 110. As introduced above, in one form the extension portion 120 is configured to supply a base torque counteracting the torques operating on the tool engagement portions 122 and 124.

Figure 17A:
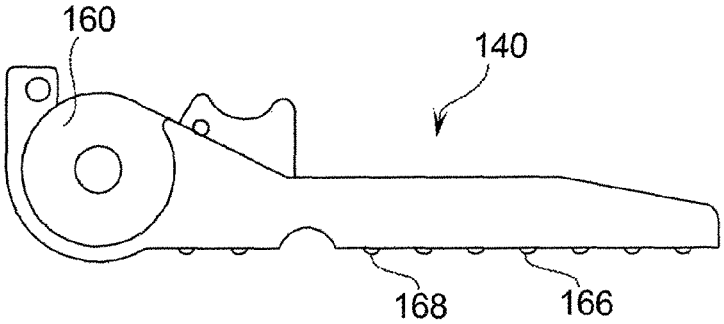
FIG. 17A-17B show one form of an optional assisted opening housing.
Figure 17B:
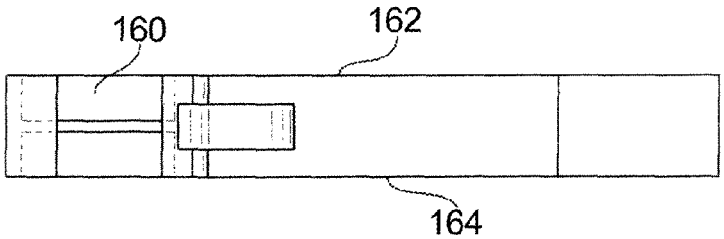

Now referring to FIGS. 17A and 17B, there is shown one form of the assisted opening housing 140. The assisted opening housing 140 has a spring housing portion 160 which is configured to position the spring member 110 therein. It should be reiterated that the assisted opening housing 140 is not shown in FIG. 2 for purposes of clarity for the teaching of the preferred embodiment of the disclosure. The assisted opening housing has lateral surfaces 162 and 164 which can assist in helping to maintain the blades in their position within the retracted orientation such as that shown at 30 and 32 in FIG. 2. The assisted opening housing further can have an exterior portion 166 which can have tactile extensions 168 to provide a better gripping surface and also allow the user to identify the area from where the blades open.

Figure 18:
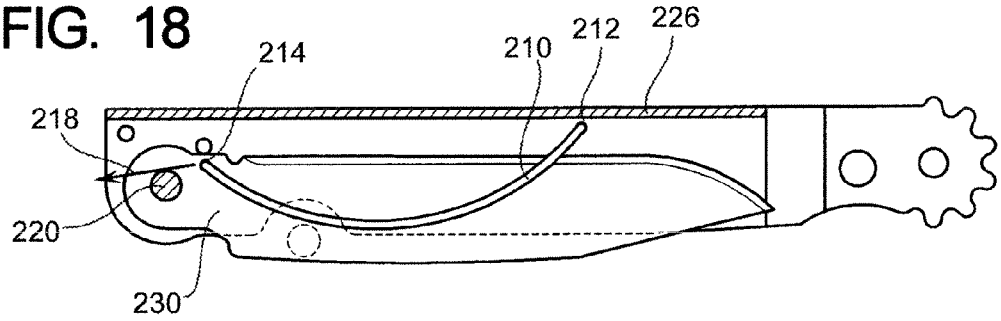
FIG. 18 shows another type of assisted opening technology where a spring member has energy stored therein, as well as the blade in a store energy state.
Figure 19:
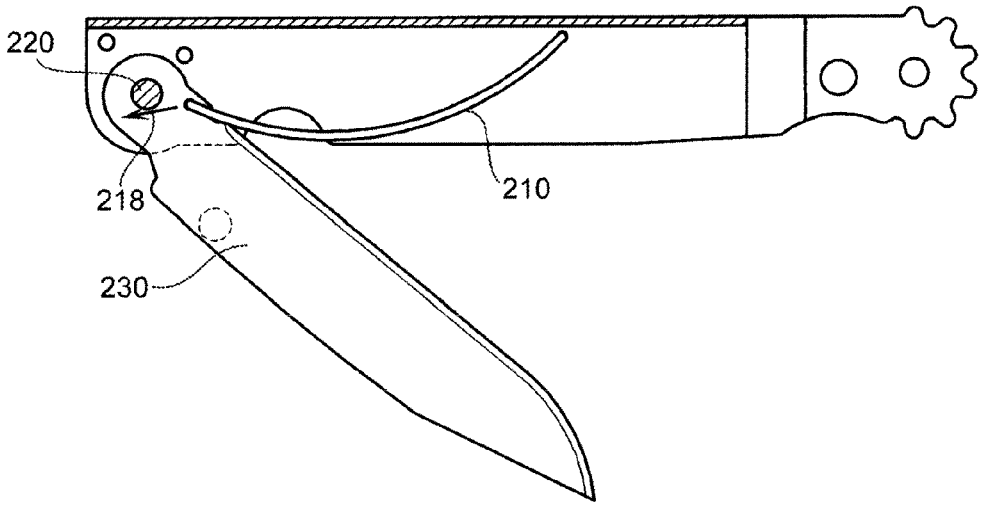
FIG. 19 shows the blade where the force acting upon the blade by the spring member is beyond an equilibrium point thereby biasing in the blade open.

FIGS. 18-19 illustrate other possible assisted opening systems. FIG. 18 shows another embodiment where a spring assisted member 210 is provided and is connected to the housing 226 at the location indicated at 212. The spring member in one form is a compressive buckling-type spring which is further connected at the location 214 upon the blade 230. It can be appreciated that the expansive force of the spring 210 is such that between the connection points 212 and 214, the force substantially extends between these contact points. Therefore, a resultant vector 218 is provided, which is a counter torque with respect to the center of rotation 220 of the blade 230.

Figure 20:
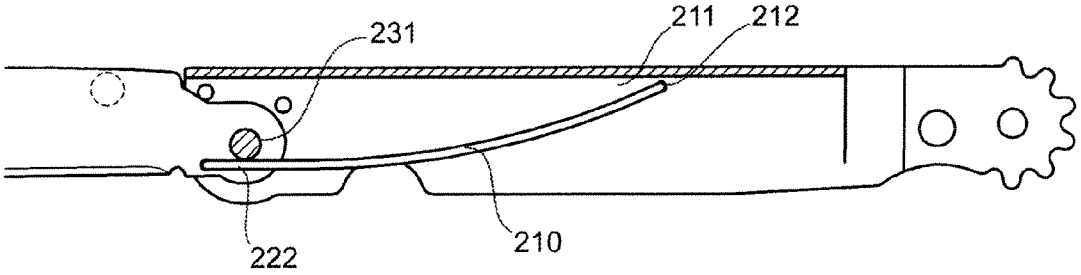
FIG. 20 shows the blade in an extended orientation.

Now referring to FIG. 19, it can be appreciated that the spring 210 is past the rotational point 220 of the blade 230, whereby the resultant vector 218 in FIG. 19 is a positive opening torque upon the blade 230. Now referring to FIG. 20, it can further be appreciated that the spring member 210 is fully extended. In one form, the forward region 222 is positioned adjacent to the center pin member 231. In other forms, a slot can be positioned at the region indicated a 211 so the attachment point 212 will slide therealong to allow the spring member 210 to move longitudinally forward.

Figure 21:
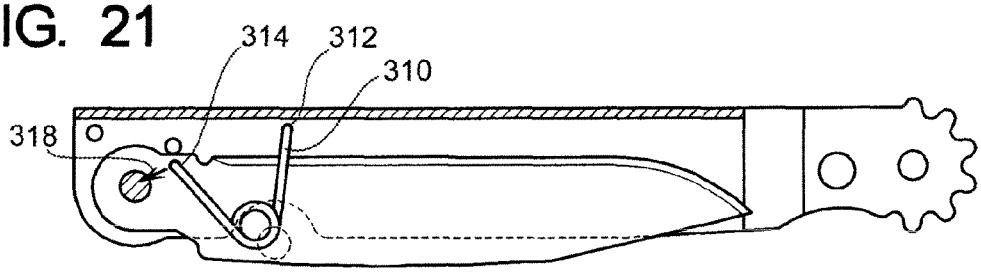
FIG. 21 shows another type of assisted open technology where a torsional type spring in a closed orientation is schematically shown.

Now referring to FIG. 21, there is shown another embodiment where a spring member 310 is provided. In this form, the spring member has an attachment point 312 and a second attachment point 314. This coil-type spring 310 has an expanding coiled energy force between the attachment points 312 and 314 and is in a high-energy state as shown in FIG. 21. In the same manner as above, the resultant vector 318 is forcing the blade into a closed orientation.

Figure 22:
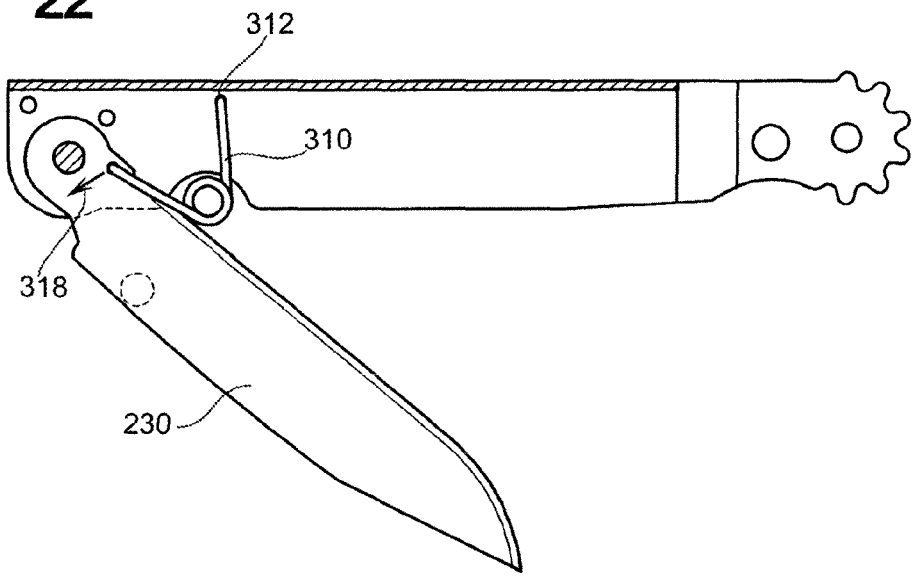
FIG. 22 shows the torsional-type spring positioned beyond an equilibrium point thereby biasing the blade open.
Figure 23:
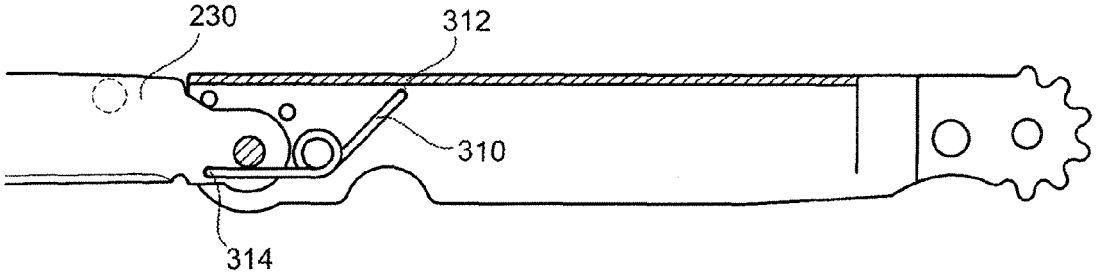
FIG. 23 shows the blade in an open orientation.

Now referring to FIG. 22, it can be appreciated that the resultant vector 318 biases the blade 232 in an open orientation. FIG. 23 shows the spring member 312 in a fully extended orientation with the blade 230 fully extended.

Figure 24:
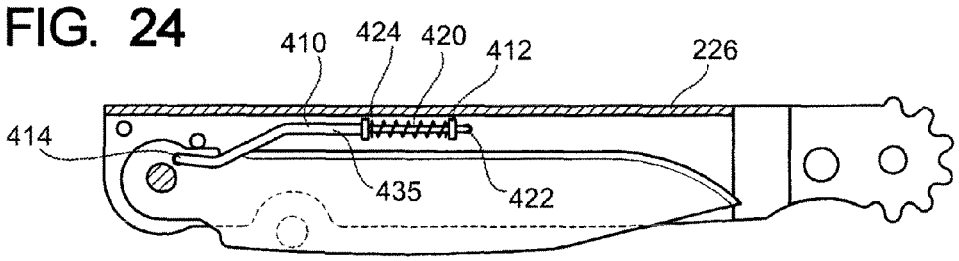
FIG. 24 shows another assisted opening technology utilizing an extending mechanism such as a plunger extending device.
Figure 25:
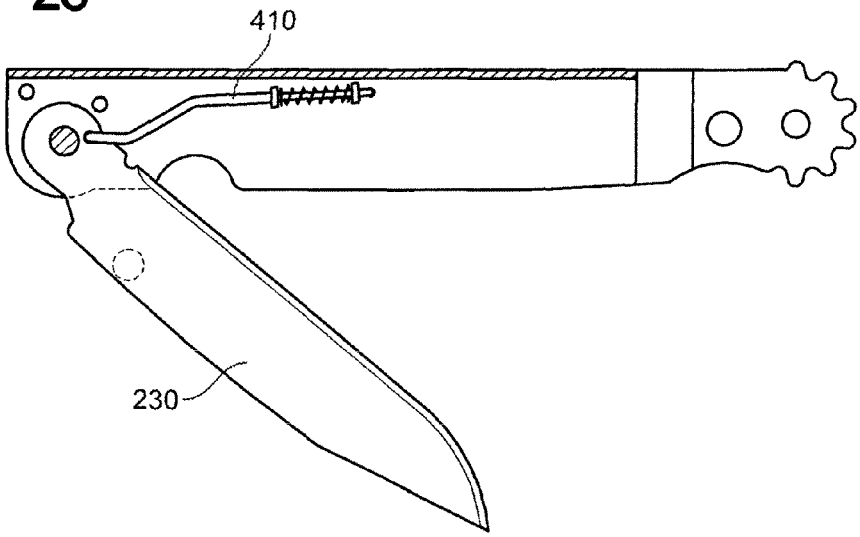
FIG. 25 shows the extending mechanism past the equilibrium point.
Figure 26:
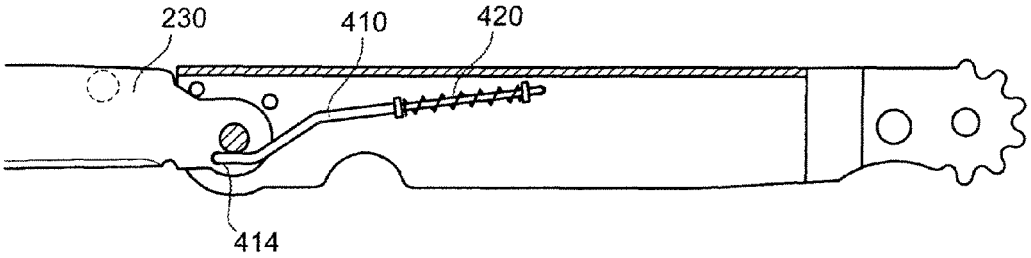
FIG. 26 shows the extending mechanism assisted opening device in the blade open orientation.

Now referring to FIG. 24, there is shown another embodiment where attached to the handle region 226 where the spring member 410 is a plunger-like spring where an actual spring element 420 is provided. In this form, the attachment point is located at 412, and a plunger-like extension member 422 can in one form extend within the hollow region within the tube portion 435. Of course, in other forms, this extension can extend through a washer-like attachment member 412. The spring abuts against the stop 424. The second attachment point 414 is on the blade and the resultant vector is present similar to the matter as described above. In this form, when the blade 230 opens beyond a prescribed level, the blade repositions to a fully opened orientation as shown in FIG. 26 where the actual spring element 420 is fully extended.

Figure 24A:
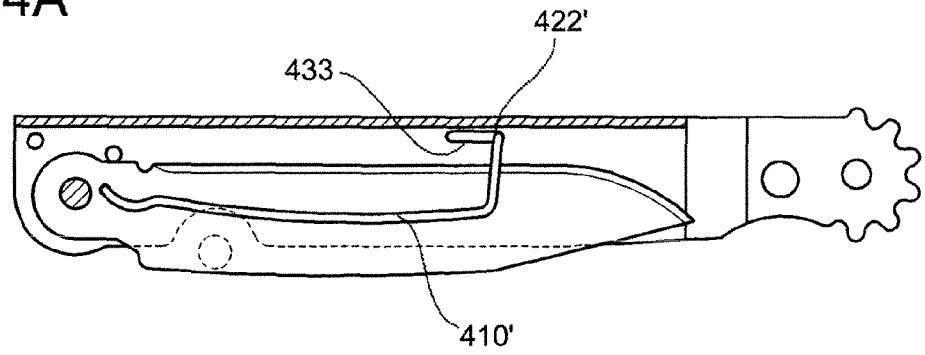
FIG. 24A shows another assisted opening technology utilizing a buckled spring mechanism.
Figure 25A:
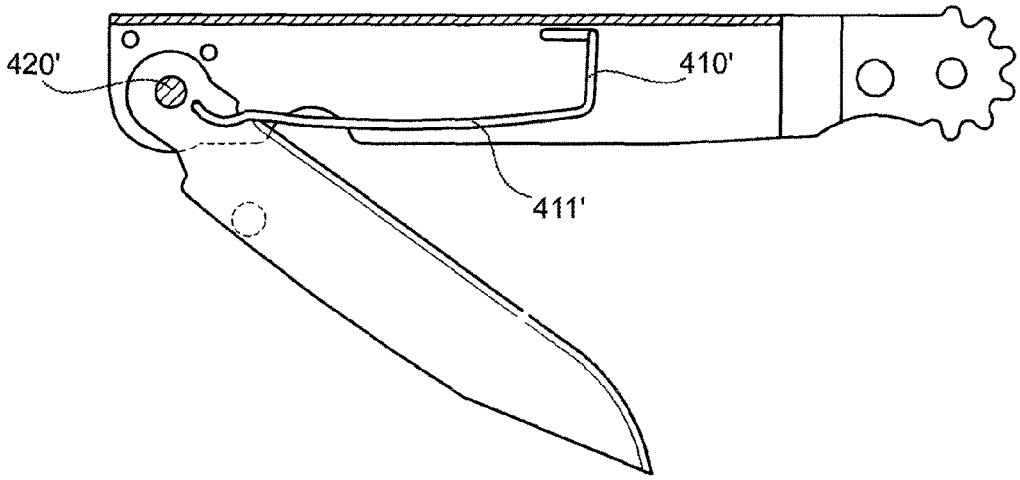
FIG. 25A shows the buckled spring mechanism past the equilibrium point.
Figure 26A:
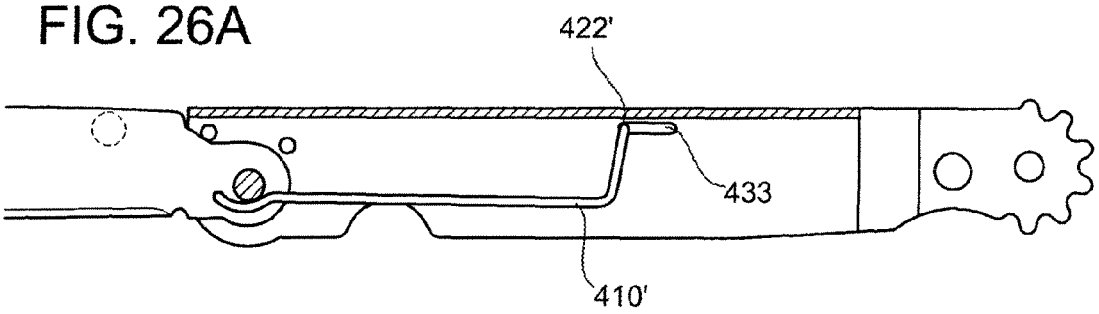
FIG. 26A shows the buckled spring mechanism assisted opening device in the blade open orientation.

Now referring to FIGS. 24A, 25A and 26A, there is shown a similar type of embodiment where the spring member 410' is in a slight compressive force as shown in FIG. 24A. The connection point 422' is fitted within the slot member 433 as shown in FIG. 25A, it can be appreciated that the stored energy within the elongated region 411' of the spring member 410' is such that a resultant force is past the center of rotation indicated at 420'. FIG. 26A shows the spring member 410' in an extended orientation where the attachment portion 422' is in the longitudinal front portion of the surface defining the slot 433.

Figure 27:
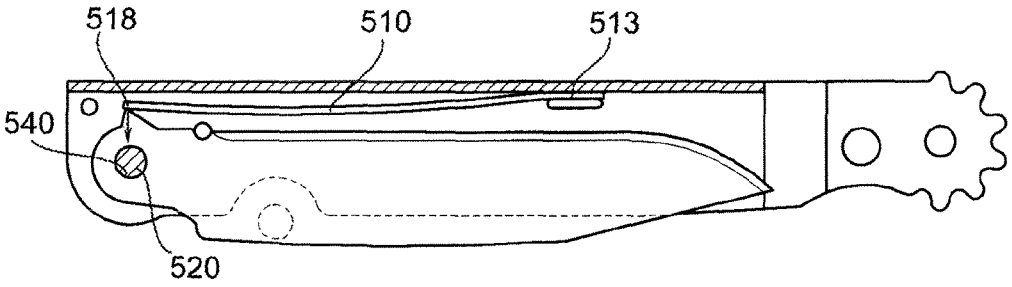
FIG. 27 shows a dog down leaf spring like embodiment where the blade is in the stored orientation.

FIG. 27 shows another embodiment of an assisted opening technology where the spring member is a dog down-like leaf spring element 510.

Figure 28:
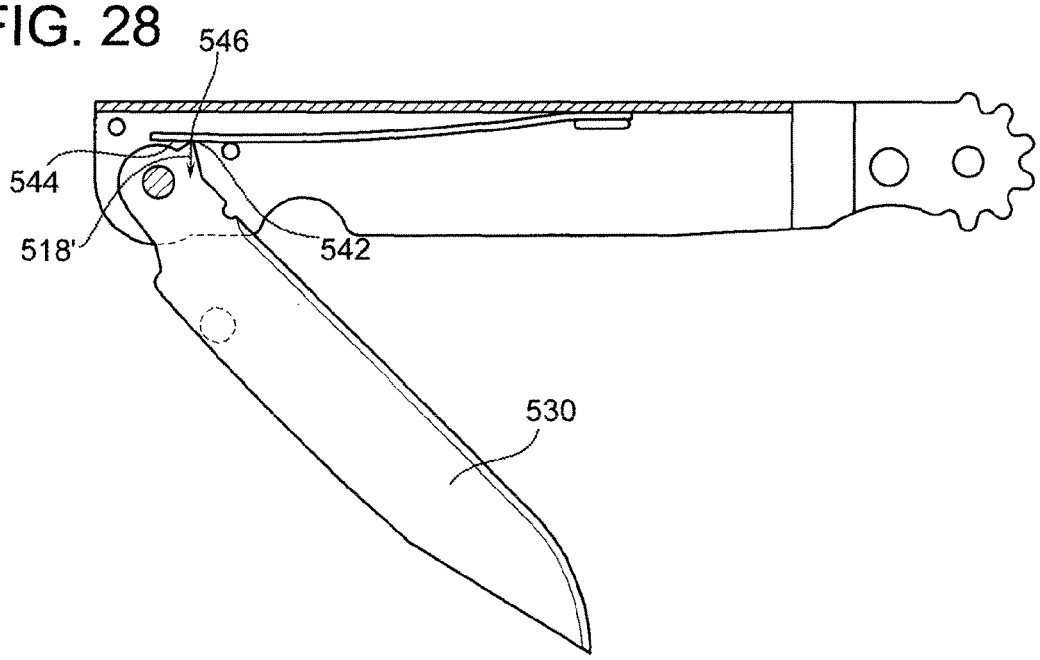
FIG. 28 shows an extension of the blade beyond the equilibrium point whereby the spring which in one form is a leaf spring is exerting a force thereupon to open the blade.

The dog down leaf spring 510 acts as a dynamic spring to provide an assisted opening initially. In this form, the center of rotation of the knife indicated at 520 is such that the force exerted by the leaf spring at the engagement point 540 is such that the resultant vector 518 produces a negative torque upon the knife, biasing it to a closed orientation. When the knife is rotated in an opening direction by an external force upon the blade, the resultant vector 518 moves to the right of the center point 520 (in the orientation is shown in FIG. 27). Thereafter, the dog down leaf spring extension 542 slides along the engagement surface 544. The engagement point 546 as show in FIG. 28 illustrates that a normal force indicated at 518' continues to bias the blade member 532 in an open orientation. In this form, the inertia of the blade 530 continues to open the blade with respect to the housing 526. The tang portion 546 is configured to slide along the region 544 of the spring member 510. The spring member can be mounted in a cantilevered spring at a location 513. It should be noted that in this form, the spring member 510 can be in line with the blade in the transverse planes. Alternatively, the spring member 510 can extend inwardly into the channel of the handle member 526.

Figure 30:
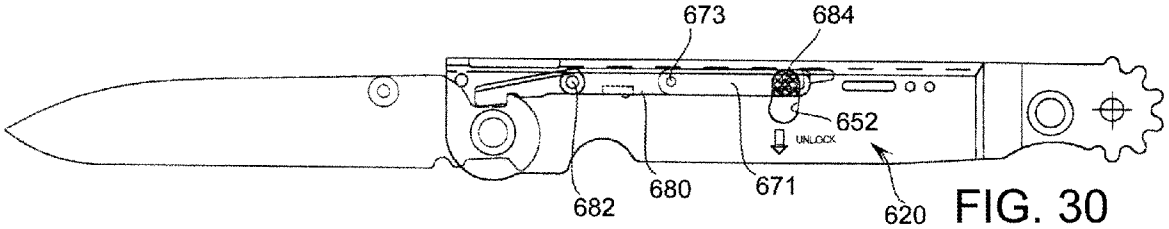
FIG. 30 shows an example of a release lever which operates as a lock back bar and further can operate as a counterforce to the first embodiment for the assisted opening technology.
Figure 31:
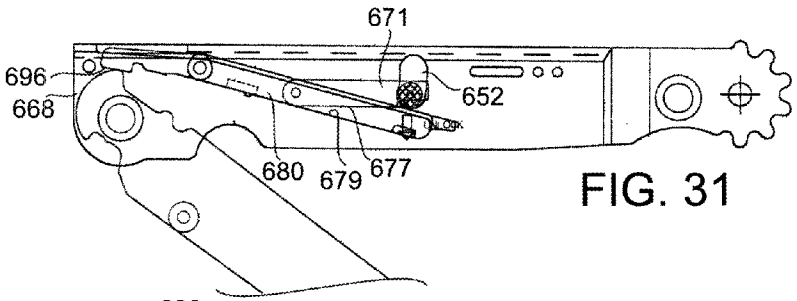
FIG. 31 shows the release bar where a portion thereof extends beyond a lateral opening.
Figure 32:
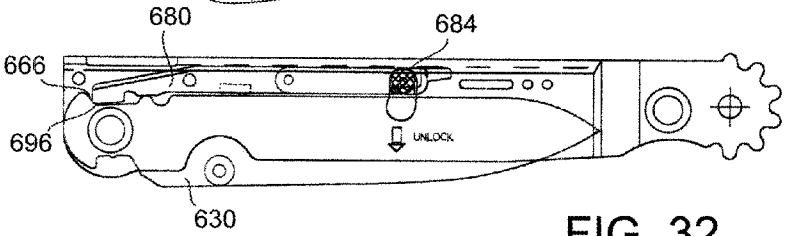
FIG. 32 shows a multitool handle in a closed orientation.
Figure 33:
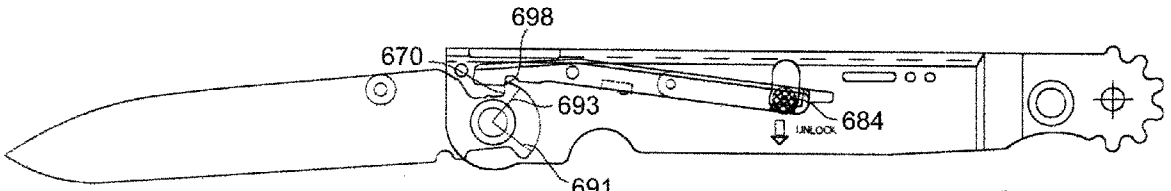
FIG. 33 shows the release bar in an extended orientation where the interface portion is depressed such that the pivotal extension member is pressing down upon the release bar to release the lever lock surface from the tool lock surface.

With the foregoing description in place regarding various types of assisted opening technologies, there will now be a description of one form of a system with a lock back bar that is particularly conducive to allowing the assisted opening technology of the first embodiment to be employed while not allowing the device to respond in the manner of the switchblade. As shown in FIG. 30, the tool handle 620 comprises a release lever 680 pivotally attached at the pivot attachment portion 682. The release lever has an extension 671 pivotally attached at the location 673. The interface portion 684 is configured to extend through the surface defining an opening indicated at 652. The extension 671 is operatively configured to rotate with respect to the release lever 680 in the counterclockwise direction, as shown in FIG. 31. However, the bottom portion 677 of the extension 671 is configured to engage the lower surface 679 of the release lever 680 to bias it to a forcefully open orientation as shown in FIG. 30. Therefore, it can be appreciated that in the closed orientation, as shown in FIG. 32, pressing the release lever 680 downwardly by applying a force to the interface portion 684 will not sufficiently rotate the release lever 680 so the cam engagement portion 696 disengages from the resistance cam surface 666. In other words, as shown in the cross-sectional profile which perhaps is best seen in FIG. 33, the distance indicated at 691 is greater than the distance indicated at 693. Therefore, a counter torque upon the blade member 630 maintains the blade in a closed orientation, as shown in FIG. 32, even when the engagement surface 64 is pressed to the unlock orientation. Now referring to FIG. 33, if the blade is opened, the engagement portion 684 can be engaged to a position as shown in FIG. 33 whereby the lever lock surface 698 disengages from the tool lock surface 670.

FIG. 31 shows the blade in an orientation where it is biased to open where the cam engagement portion 696 rides along the cam open portion 668 where because of the distances 693 and 691 as shown in FIG. 33 are reduced, there can be an additional assisted force acting upon the blade in addition to the spring biasing opening force of the main spring. It can be seen in FIG. 31 how the release lever 680 will extend beyond the allowable range of travel of the extension 671 where the limits of rotation of the extension are limited by the range of the opening 652.

Figure 29:
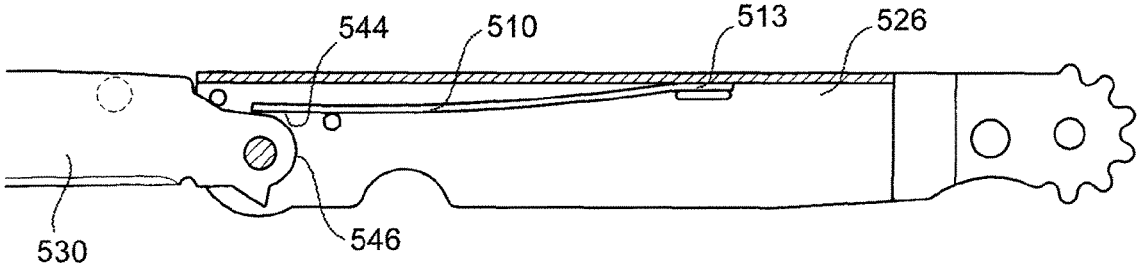
FIG. 29 shows the blade in an open orientation.
Figure 35:
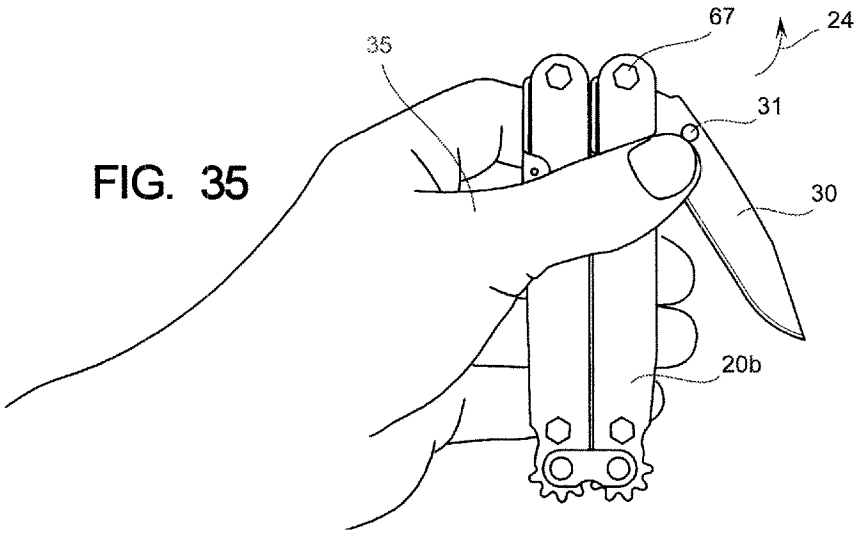
FIG. 35 shows an assisted opening multitool device with a tool in an intermediate opening position.

Now referring to FIGS. 34 and 35, there can be seen one mode of operation of the multitool 18. The multitool 18 is comprised of first and second handle members 20*a* and 20*b*. In operation, the operator grasping the multitool 18 can use one of his or her fingers, such as the thumb, to engage the thumbstud 31 to apply the force 24 thereupon. The user's hand 35 can of course position the multitool to a plurality of orientations. It should be further noted that the tool member 30 could be reoriented in other locations, such as pivotally attached at the longitudinally forward region 37 where, for example, an in-line system like a dog-down leaf spring as described above with reference to FIGS. 27-29 could be utilized. Attaching the tool 30 at the pivot attachment location 67 in the longitudinally rearward portion is advantageous because the mechanisms for the assisted opening technologies can be employed given the lateral space within the channel region of the handle member. Of course, the channel region can be a U-shaped channel or two opposing pieces of material. FIG. 35 shows force continuing to be applied to the tool member 30, which in one form is applied via the thumb stud 31. At a prescribed angle with respect to the handle portion 20*b*, the assisted opening technology utilizes one of the above-mentioned forms of an assisted opening mechanism, as well as other possible forms, to bias the tool member 32 the open orientation in a very dynamic fashion. Of course, other types of tool members besides a blade can be utilized, such as scissors, a file, a screwdriver, a seatbelt cutter, or any other type of tool member that can be fit within the channel region of the multitool 18.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. An assisted opening multitool comprising:

a first handle having a longitudinal axis and a lateral axis, the first handle having first and second longitudinal regions, the first handle having an interior surface defining a channel region, a second handle having an interior surface defining a channel region, a tool member pivotally attached to the first handle and operatively configured to be positioned in a closed orientation within the channel region and configured to rotate in an opening direction to an open orientation, an assisted opening system comprising a spring system operatively attached to the tool member where the spring system provides rotational resistance of the tool member for a first portion of rotation of the tool member from the closed orientation to the open orientation, and the spring system provides positive torque for a second portion of rotation between the closed orientation and the open orientation where the second portion of rotation is after the first portion of rotation from the closed orientation to the open orientation of the tool member with respect to the first handle, where the assisted opening system comprises a release lever comprising an interface portion positioned on a lateral region of the first handle, and the release lever comprises a cam engagement portion to engage a tool cam surface of the tool member, the tool cam surface comprising a resistance cam surface portion where contact between the cam engagement portion of the release lever and the resistance cam surface portion provides a torque upon the tool member in a closing direction when the tool member is positioned at the first portion of rotation with respect to the first handle, and where the tool cam surface comprises a cam opening portion having a substantially constant radius at the second portion of rotation of the tool member at a point of engagement of the cam engagement portion of the release lever and the cam opening portion of the tool cam surface.

* * * * *